US009278252B1

(12) United States Patent
Will

(10) Patent No.: US 9,278,252 B1
(45) Date of Patent: Mar. 8, 2016

(54) ABDOMINAL EXERCISE MACHINE

(71) Applicant: Hershel Will, Los Angeles, CA (US)

(72) Inventor: Hershel Will, Los Angeles, CA (US)

( * ) Notice: Subject to any disclaimer, the term of this patent is extended or adjusted under 35 U.S.C. 154(b) by 0 days.

(21) Appl. No.: 14/507,549

(22) Filed: Oct. 6, 2014

(51) Int. Cl.

| | |
|---|---|
| ***A63B 23/02*** | (2006.01) |
| ***A63B 21/00*** | (2006.01) |
| ***A63B 21/055*** | (2006.01) |
| ***A63B 21/06*** | (2006.01) |
| ***A63B 21/16*** | (2006.01) |

(52) U.S. Cl.
CPC ..... *A63B 23/0222* (2013.01); *A63B 21/00185* (2013.01); *A63B 21/055* (2013.01); *A63B 21/06* (2013.01); *A63B 21/16* (2013.01)

(58) Field of Classification Search
CPC .... A63B 21/1473; A63B 23/00; A63B 23/02; A63B 23/0205; A63B 23/0211; A63B 23/0216; A63B 23/0222; A63B 23/0227; A63B 23/0233; A63B 23/035; A63B 23/03516; A63B 23/03575; A63B 23/04; A63B 23/12; A63B 23/1245; A63B 21/00; A63B 21/02; A63B 21/04; A63B 21/0407; A63B 21/0442; A63B 21/00185; A63B 21/055; A63B 21/0552; A63B 21/0555; A63B 21/0557
USPC ..... 482/121, 140
See application file for complete search history.

(56) References Cited

U.S. PATENT DOCUMENTS

| | | | | | |
|---|---|---|---|---|---|
| 5,545,114 | A * | 8/1996 | Gvoich | A63B 21/0552 | 482/123 |
| 5,599,261 | A * | 2/1997 | Easley | A63B 21/0552 | 482/130 |
| 5,665,041 | A * | 9/1997 | Hsieh | A63B 23/0222 | 482/123 |
| 5,913,757 | A * | 6/1999 | Winters | A63B 23/0211 | 482/123 |
| 7,232,405 | B2 * | 6/2007 | Ko | A63B 22/14 | 482/140 |
| 8,398,530 | B1 * | 3/2013 | Rubens | A63B 21/00185 | 482/131 |
| 8,900,105 | B2 * | 12/2014 | Zhu | A63B 21/0004 | 482/127 |
| 2003/0100415 | A1 * | 5/2003 | Augustine | A63B 21/00181 | 482/140 |
| 2007/0027008 | A1 * | 2/2007 | Levinson | A63B 21/0004 | 482/121 |
| 2007/0135281 | A1 * | 6/2007 | Liao | A63B 21/0004 | 482/140 |
| 2009/0312164 | A1 * | 12/2009 | Placencia | A63B 23/0211 | 482/126 |
| 2010/0160126 | A1 * | 6/2010 | Nardone | A63B 21/0004 | 482/140 |
| 2011/0195826 | A1 * | 8/2011 | Nayebdadash | A63B 23/0227 | 482/140 |
| 2012/0316041 | A1 * | 12/2012 | Meister | A63B 23/0494 | 482/140 |

* cited by examiner

*Primary Examiner* — Loan H Thanh
*Assistant Examiner* — Andrew S Lo
(74) *Attorney, Agent, or Firm* — Michael N. Cohen; Cohen IP Law Group PC

(57) ABSTRACT

An abdominal exercise machine for providing crunch-type exercises for upper and lower abdominal muscles comprises a support frame assembly and a back support member. The support frame assembly comprises a U-shaped right frame member and a left frame member which allow a user to perform various crunch type abdominal workouts. An upper right resistance band and an upper left resistance band get stretched when the user pulls an upper crossbar in a downward direction to create a weighted resistance that enables the user to achieve intense upper abdominal crunch workouts. A lower right resistance band and a lower left resistance band get stretched when the user lifts a right and a left feet inserted into a right and a left foot holding means respectively thereby creating the weighted resistance that enables the user to achieve intense lower abdominal crunch workouts.

19 Claims, 6 Drawing Sheets

ABDOMINAL EXERCISE MACHINE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE DISCLOSURE

The present embodiment relates generally to exercise machines, and more particularly, to an abdominal exercise machine having a plurality of resistance bands configured to provide varied resistance for upper and lower abdominal workouts.

DISCUSSION OF RELATED ART

Abdominal muscle group exercises are performed either with or without the assistance of an exercise machine. In both cases, the weight of the upper torso plays an important role for providing resistance to contract the abdominal muscles while raising the upper torso. The upper portion of the abdominal muscles is effectively exercised by performing repetitions of "sit-ups" using the "crunch" technique. In this context, "crunch" refers to the motion in which the trunk of the human body is raised from a supine position. When the spine is in a flexed position, the anterior portion of the spine is concave and the posterior portion of the spine is convex. The lower portion of the abdominal muscles is effectively exercised by performing repetitions of "leg raise" exercises.

Commonly used abdominal-muscle exercise machines range in complexity from basic static inclined benches with an adjustable inclination angle that hold the feet locked together, to more complex machines which have one or more moving components to assist in maintaining a uniform and consistent range of motion. Also, a well-designed abdominal-muscle exercise machine may reduce the risk of inadvertent strain damage to other muscle groups, specifically the lower back, which is the most common muscle group damaged by strain during abdominal muscle exercise. Hence it is important to ensure that the abdominal muscles are efficiently exercised during every repetition by keeping the motion of the body in a uniform, consistent and effective range of motion, maximizing workout efficiency and safety.

A variety of abdominal exercising machines have been developed. Some machines typically include a resistive member that is a variation of a springing mechanism. Some machines possess a single spring or a plurality of springs. These springs are integral parts of a sliding assembly to provide a resistive force to achieve a more effective abdominal exercise. When the springing mechanisms are located on the outside of a sliding assembly, the user is in constant jeopardy of being pinched by the mechanism during exercising. If the springing mechanisms are located inside of a sliding assembly, the user is unable to easily access the mechanisms.

The effectiveness of abdominal exercises varies depending on the type of exercising apparatus. For example, exercise machines which offer additional mechanical resistance during the exercise routine are much more efficient and proven to give better results. Recently, some abdominal exercise machines that allow a user to develop their abdominal muscles by lying on the floor using a framework to support their head, neck and shoulders have become popular. A curvature or other formation in the framework enables it to be displaced in a rolling motion to assist the user during abdominal crunch exercises. However, this type of machine does not provide sufficient resistance to both the crunch movement and the leg raise exercises. Moreover, these machines use rectangular pinned plate and cable pulley designs which are bulky, lack portability, and can be quite expensive.

Various methods exist to alleviate the aforementioned problems. One such method describes an abdominal exercise device made of a one piece skeletal frame. The flame defines a pair of support rails, a pair of arcuate rocker portions, a pair of arm rest portions and an upstanding arch-shaped portion connecting the support rails together. However, this device also has considerable drawbacks since it does not provide proper back support to the user by having a floor mat to prevent stress and injuries to the back during normal crunches\sit ups and leg raises. Further, this device does not provide sufficient resistance during crunch/sit-up and leg raise exercises to quickly achieve the desired results.

Another method describes an exercise machine for the abdominal muscles, that also works the back muscles, and the arm muscles of a user. This machine comprises a rectangular tubular frame having a seat pad. The frame has a right-angled pull bar assembly pivotally affixed. Similarly, however, this device does not provide sufficient resistance during crunch/sit-up and leg raise exercises to quickly achieve the desired results.

Therefore, there is a need for an abdominal exercise device that is used for exercising both the upper portion and lower portions of the abdominal muscles. Such a needed device would provide sufficient resistance for both sit-ups/crunch movements and leg-lift exercises for more intense and effective abdominal workouts. Further, the needed device would offer head, neck, and back support to the user by including a floor mat and head rest to prevent stress and injuries to the neck and back during crunches/sit ups and leg lifts. In addition, this needed abdominal exercise machine would be simple, portable, easily stored, as well as economical and user friendly. The present embodiment accomplishes these objectives.

SUMMARY OF THE DISCLOSURE

The present embodiment is an abdominal exercise machine for providing crunch-type exercises for both upper and lower abdominal muscles. The abdominal exercise machine comprises a support frame assembly and a back support member. The support frame assembly comprises a right frame member and a left frame member which allow a user to perform various crunch type abdominal workouts. In the preferred embodiment, the right and the left frame members are U-shaped. The right frame member includes a first right end and a second right end. The left frame member includes a first left end and a second left end. An upper crossbar having a plurality of attachment means is designed to connect the first right end and the first left end of the U-shaped frame members.

The support frame assembly further comprises a right arm supporting member and a left arm supporting member which allow elbows of the user to rest while performing upper and lower abdominal workouts. The right arm supporting member is connected to the second right end and the left arm supporting member is connected to the second left end. The right frame member and the left frame member are connected to a lower crossbar. The lower crossbar includes a head support member at a middle portion thereof and provides a cushion support to the user's head.

The back support member includes a top surface, a bottom surface, a first upper weight, a second upper weight, a first lower weight and a second lower weight. The plurality of weights firmly prevents the back support member from slipping on a floor while the user performs the abdominal workouts. In the preferred embodiment, the back support member is an exercise mat or a yoga mat that gives support and comfort to the back portion of the user.

The abdominal exercise machine further comprises an upper right resistance band, an upper left resistance band, a lower right resistance band and a lower left resistance band. The upper right resistance band and the upper left resistance band are connected to the back support member and the upper crossbar. The lower right resistance band is connected to the first lower weight and the right foot holding means. The lower left resistance band is connected to the second lower weight and the left foot holding means. The right foot holding means and the left foot holding means are designed to hold the foot of the user. The user inserts the foot into the right foot holding means and into the left foot holding means.

The upper right resistance band includes a first upper right end and a second upper right end. The upper left resistance band includes a first upper left end and a second upper left end. The abdominal exercise machine further comprises a plurality of fastening means. The first upper right end is releasably connected to one of the plurality of attachment means and the first upper left end is releasably connected to another one of the plurality of attachment means utilizing at least one of the plurality of fastening means. The second upper right end is releasably connected to the first upper weight utilizing the at least one of the plurality of fastening means. The second upper left end is connected to the second upper weight utilizing the at least one of the plurality of fastening means.

The abdominal exercise machine further comprises a lower right resistance band and a lower left resistance band. The lower right resistance band includes a first lower right end and a second lower right end. The lower left resistance band includes a first lower left end and a second lower left end. The first lower right end is releasably connected to the first lower weight utilizing the at least one of the plurality of fastening means. Similarly, the first lower let end is releasably connected to the second lower weight utilizing the at least one of the plurality of fastening means. The abdominal exercise machine further comprises a right foot holding means and a left foot holding means. The second lower right end is releasably connected to the right foot holding means and the second lower left end is releasably connected to the left foot holding means. The right foot holding means and the left foot holding means are designed to receive a foot of the user.

In the preferred embodiment, the abdominal exercise machine allows the user to perform upper abdominal exercises and lower abdominal exercises either simultaneously or separately. The upper right resistance band and the upper left resistance band are stretchable and enable the user to perform various abdominal workouts in a more intense and an effective manner. The upper right and an upper left resistance bands get stretched as the user pulls the upper crossbar in a downward direction thereby creating a weighted resistance. This weighted resistance enables the user to achieve intense upper abdominal crunch workouts. Similarly, the lower right and the lower left resistance bands get stretched as the user lifts the right and the left feet inserted into a right and a left foot holding means respectively to create a weighted resistance that enables the user to achieve the intense lower abdominal crunch workouts.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The following describes example embodiments in which the present invention may be practiced. This invention, however, may be embodied in many different ways, and the description provided herein should not be construed as limiting in any way.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
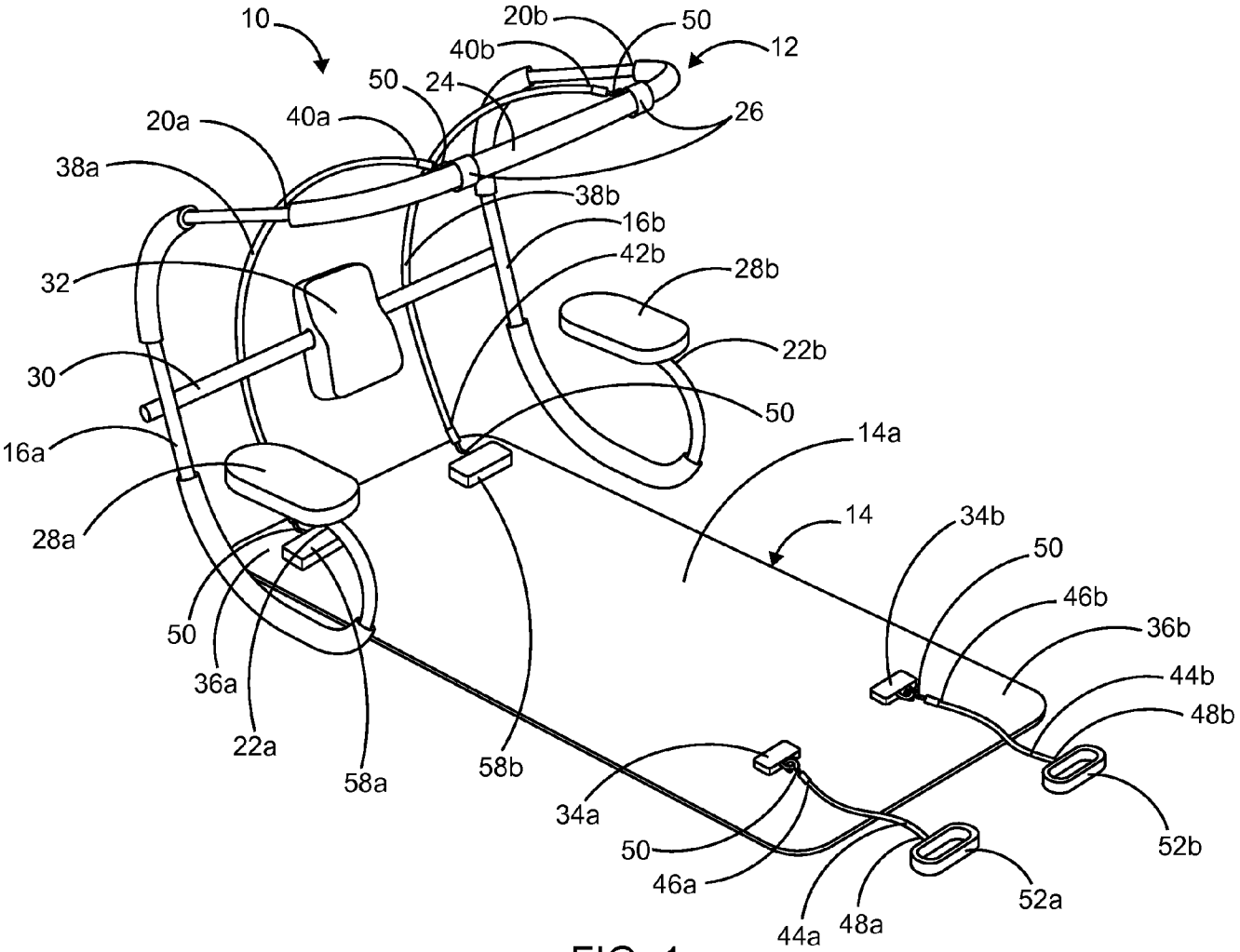
FIG. 1 is a perspective view of a preferred embodiment of an abdominal exercise machine in accordance with the present invention.

Referring now to FIGS. 1-6 of the drawings, a preferred embodiment of an abdominal exercise machine for providing crunch-type exercises and leg raise exercises for upper and lower abdominal muscles according to the present invention is illustrated in different views and generally designated by the reference numeral 10. As shown in FIG. 1, the abdominal exercise machine 10 comprises a support frame assembly 12 and a back support member 14. The support frame assembly 12 provides secure support for the abdominal exercise machine 10 against a base, such as a floor 60 (See FIG. 4) or any flat surface. The support frame assembly 12 comprises a right frame member 16*a* and a left frame member 16*b*. In the preferred embodiment, the right frame member 16*a* and the left frame member 16*b* are U-shaped. The right frame member 16*a* includes a first right end 20*a* and a second right end 22*a*. The let flame member 16*b* includes a first let end 20*b* and a second left end 22*b*. The abdominal exercise machine 10 further comprises an upper crossbar 24 having a plurality of attachment means 26. The upper crossbar 24 connects the right frame member 16*a* with the left frame member 16*b*.

The support frame assembly 12 further comprises a right arm supporting member 28*a* and a left arm supporting member 28*b*. The right arm supporting member 28*a* and the left arm supporting member 28*b* allow a user 18 (See FIG. 5) to rest the elbows 56 (See FIG. 5) thereon while performing the upper and lower abdominal workouts. The right arm supporting member 28*a* is connected to the second right end 22*a* of the right frame member 16*a*. Similarly, the left arm supporting member 28*b* is connected to the second left end 22*b* of the left frame member 16*b*. A lower crossbar 30 is attached with the right frame member 16*a* and the left frame member 16*b*. The lower crossbar 30 includes a head support member 32 that provides comfortable head support to the user 18. The head support member 32 is attached at a middle portion of the lower crossbar 30. The head support member 32 prevents the user's head and neck from stress and injuries while the user 18 performs the abdominal crunch movements and leg raise exercises. The head support member 32, the right arm supporting member 28*a* and the left arm supporting member 28*b* provide cushion like comfort to the user 18. The abdominal exercise machine 10 further comprises a plurality of fastening means 50. In the preferred embodiment, the plurality of fastening means 50 is selected from a group consisting of hooks, clamps, staples, pins, Velcro, tapes, adhesives, magnets, clasps, hooks and buckles.

The back support member 14 includes a top surface 14*a*, a bottom surface 14*b* (See FIG. 3), a first upper weight 58*a*, a second upper weight 58*b*, a first lower weight 34*a* and a second lower weight 34*b*. The first upper weight 58*a* and the second upper weight 58*b* are positioned on an upper end 36*a* of the top surface 14*a*. The first lower weight 34*a* and the second lower weight 34*b* are positioned on a lower end 36*b*. The first upper weight 58*a*, the second upper weight 58*b*, the first lower weight 34*a* and the second lower weight 34*b* securely keep the back support member 14 on the floor 60 without slipping while the user 18 performs the upper and lower abdominal workouts. In the preferred embodiment, the back support member 14 is an exercise mat or a cushion or a yoga mat that provides support and comfort to the back portion of the user 18. Further, the back support member 14 prevents the back portion of the user 18 from stress and injuries during sit ups/crunch movements. The back support member 14 is portable and transferable to any flat surface. The first upper weight 58*a*, the second upper weight 58*b*, the first lower weight 34*a* and the second lower weight 34*b* can be constructed of any suitable material such as metal.

Figure 2:
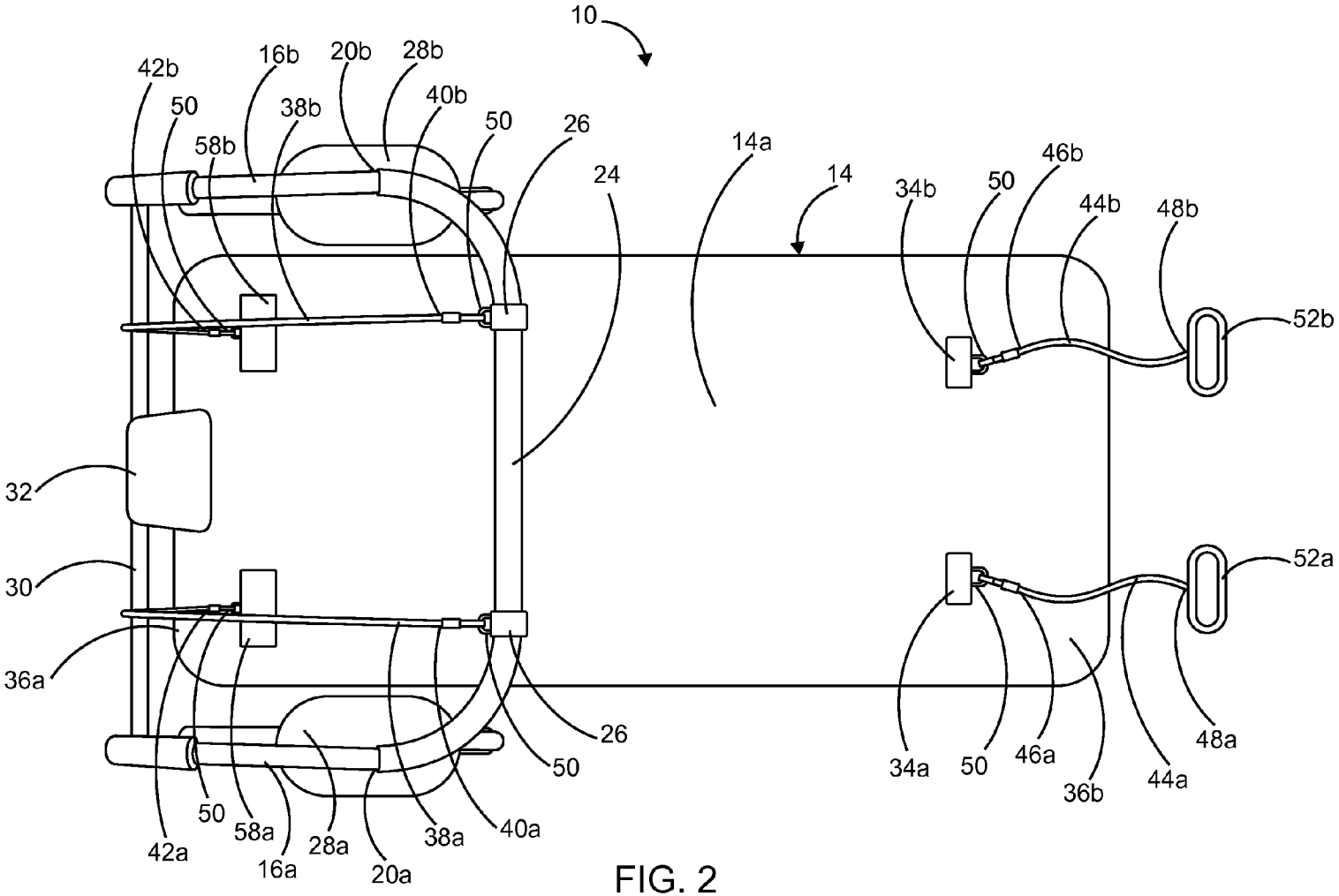
FIG. 2 is a top perspective view of the abdominal exercise machine in accordance with the present invention.
Figure 3:
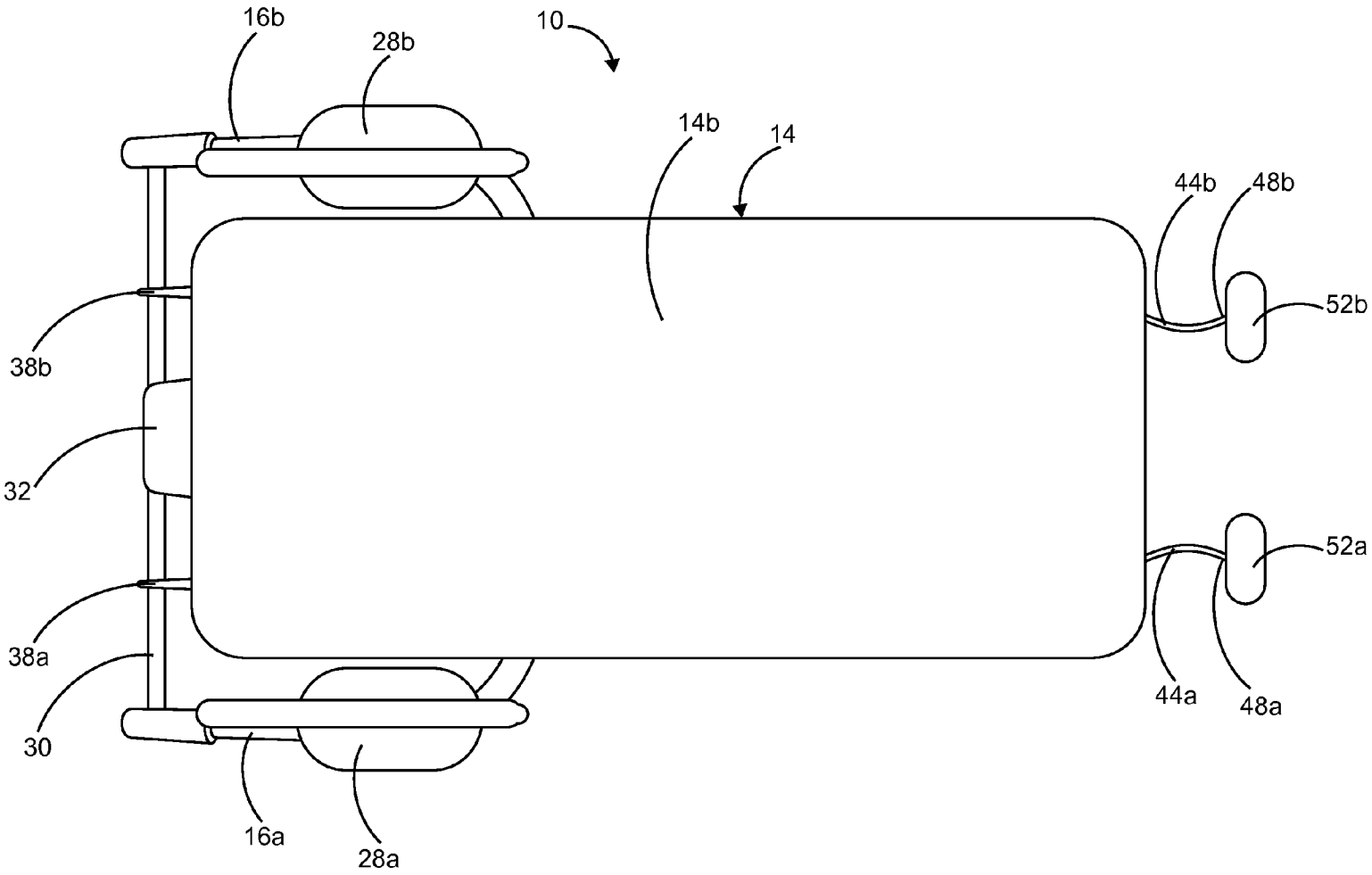
FIG. 3 is a bottom perspective view of the abdominal exercise machine in accordance with the present invention.
Figure 4:
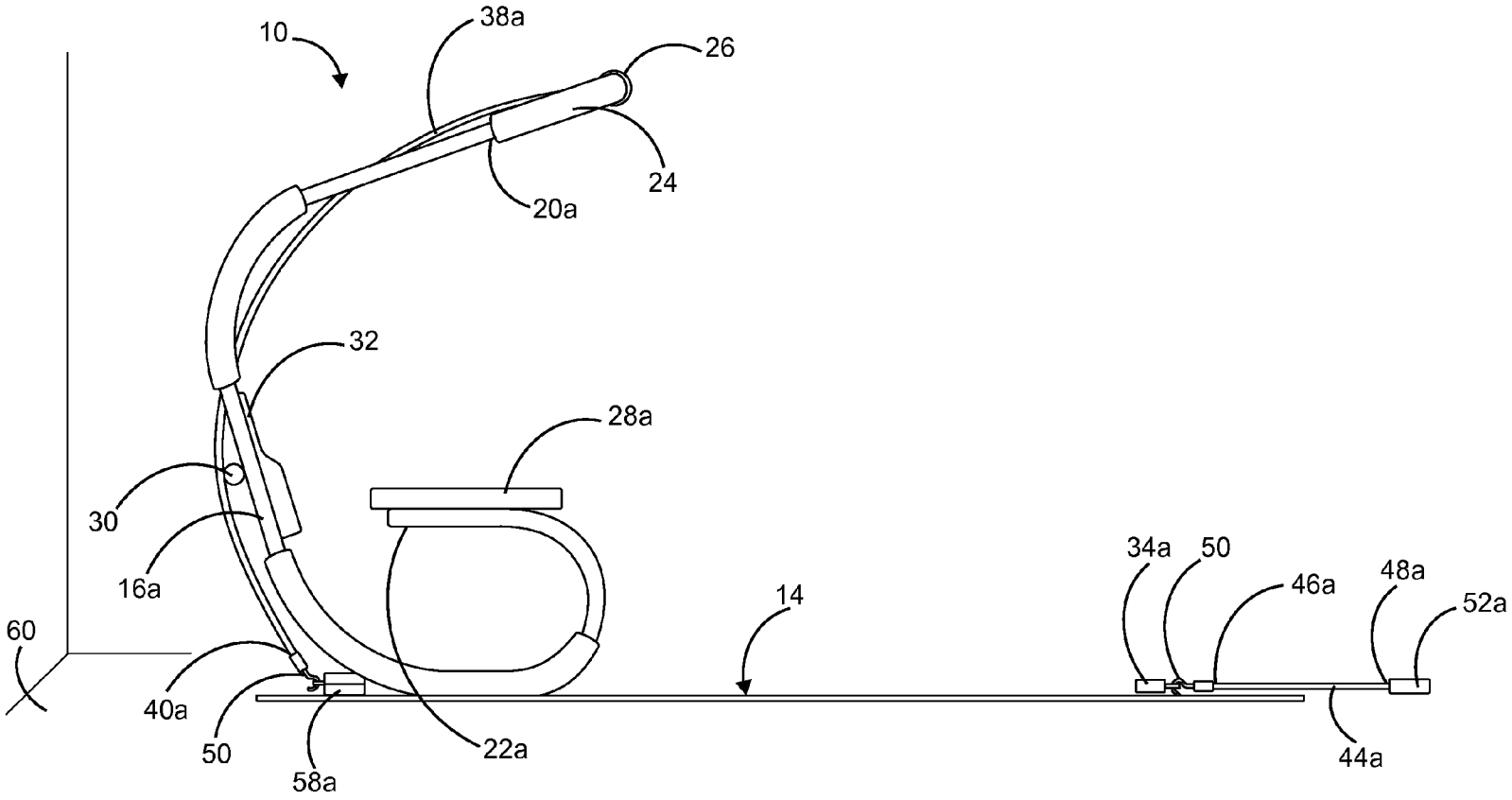
FIG. 4 is a side perspective view of the abdominal exercise machine in accordance with the present invention.

Referring to FIGS. 2-4, the abdominal exercise machine 10 further comprises an upper right resistance band 38*a* and an upper left resistance band 38*b*. The upper right resistance band 38*a* and the upper left resistance band 38*b* are connected to the upper crossbar 24 and the back support member 14. The upper right resistance band 38*a* includes a first upper right end 40*a* and a second upper right end 42*a*. The upper left resistance band 38*b* includes a first upper left end 40*b* and a second upper left end 42*b*. The first upper right end 40*a* is releasably connected to one of the plurality of attachment means 26 utilizing at least one of the plurality of fastening means 50. The first upper left end 40*b* is releasably connected to another one of the plurality of attachment means 26 utilizing the at least one of the plurality of fastening means 50. The second upper right end 42*a* is releasably connected to the first upper weight 58*a* utilizing the at least one of the plurality of fastening means 50. The second upper left end 42*b* is connected to the second upper weight 58*b* utilizing the at least one of the plurality of fastening means 50. The upper right resistance band 38*a* and the upper left resistance band 38*b* are stretchable and allow the user 18 to perform various abdominal workouts in a more intense and in effective manner.

The abdominal exercise machine 10 further comprises a right foot holding means 52*a* and a left foot holding means 52*b*. The back support member 14 comprises a lower right resistance band 44*a* and a lower left resistance band 44*b*. The lower right resistance band 44*a* is connected to the first lower weight 34*a* and the right foot holding means 52*a*. The lower left resistance band 44*b* is connected to the second lower weight 34*b* and the left foot holding means 52*b*. The lower right resistance band 44*a* includes a first lower right end 46*a* and a second lower right end 48*a*. The lower left resistance band 44*b* includes a first lower left end 46*b* and a second lower left end 48*b*. The first lower right end 46*a* is releasably connected to the first lower weight 34*a* utilizing the at least one of the plurality of fastening means 50. Similarly, the first lower left end 46*b* is releasably connected to the second lower weight 34*b* utilizing the at least one of the plurality of fastening means 50.

The right foot holding means 52*a* and the left foot holding means 52*b* are designed to insert into a foot 54 of the user 18. The upper right and the upper left resistance bands 38*a*, 38*b* get stretched when the user pulls the upper crossbar 24 in a downward direction thereby creating a weighted resistance. This weighted resistance enables the user 18 to achieve intense upper abdominal crunch workouts. Similarly, the lower right and the lower left resistance bands 44*a*, 44*b* get stretched when the user 18 lifts the right and the left feet 54 which being inserted into the right and left foot holding means 52*a*, 52*b* respectively thereby creating a weighted resistance that enables the user 18 to achieve the intense lower abdominal crunch workouts. The efficiency of the abdominal exercise machine 10 and the resistance bands 38*a*, 38*b*, 44*a*, 44*b* help the user 18 to reduce belly flat and strengthen the abdominal muscles. In the preferred embodiment, the right foot holding means 52*a* and the left foot holding means 52*b* can be constructed of any suitable material such as metal or plastic.

Figure 5:
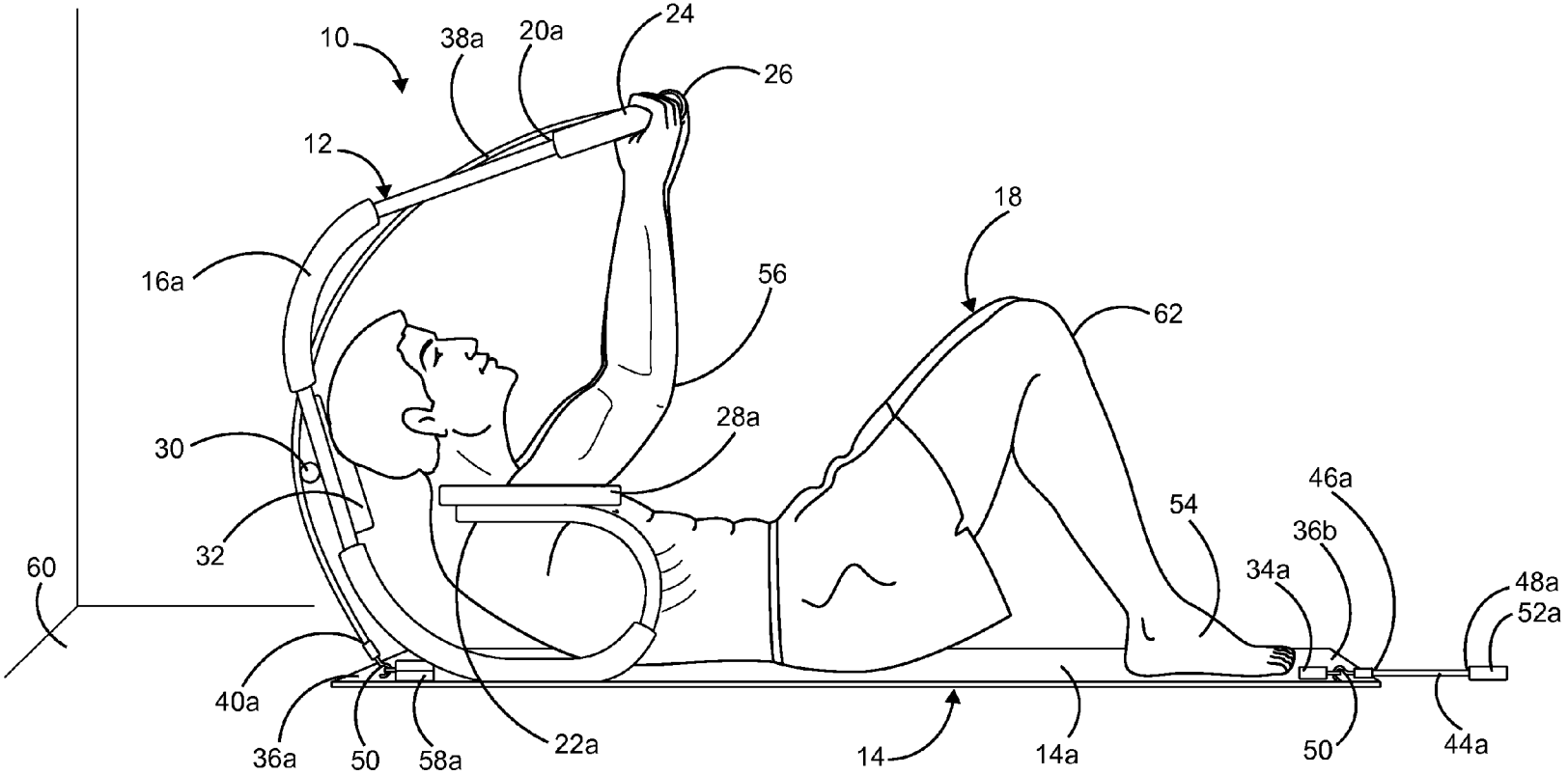
FIG. 5 is a side perspective view of the abdominal exercise machine while in use to perform upper abdominal exercises.

FIG. 4 illustrates a side perspective view of the abdominal exercise machine 10. In the preferred embodiment, the abdominal exercise machine 10 is foldable to save storage space. Referring specifically to FIG. 5 of the drawings, the user 18 is performing the abdominal exercise for the upper abdominal muscles. The support frame assembly 12 and the back support member 14 are positioned on the floor 60. As shown in FIG. 5, the user 18 is lying on the top surface 14*a* of the back support member 14 with the head positioned on the head support member 32. The head, neck and upper body portion of the user 18 are positioned between the right frame member 16*a* and the left frame member 16*b* as well as between the right arm supporting member 28*a* and the left arm supporting member 28*b*. In this position as described hereinabove and illustrated in FIG. 5, the user 18 extends the elbows 56 in an upward direction to hold and pull the upper crossbar 24. The pulling of the upper crossbar 24 in a downward direction stretches the upper right resistance band 38*a* and the upper left resistance band 38*b* to create the weighted resistance that enables the user 18 to achieve the intense upper abdominal crunch movements. The user 18 imparts a downward force from the elbows 56 during the upper abdominal workouts. The stretching of the resistance bands 38*a*, 38*b* causes the back portion of the user 18 to elevate from the back support member 14 which enables the abdominal exercise machine 10 to perform a number of sit-up type exercises.

Figure 6:
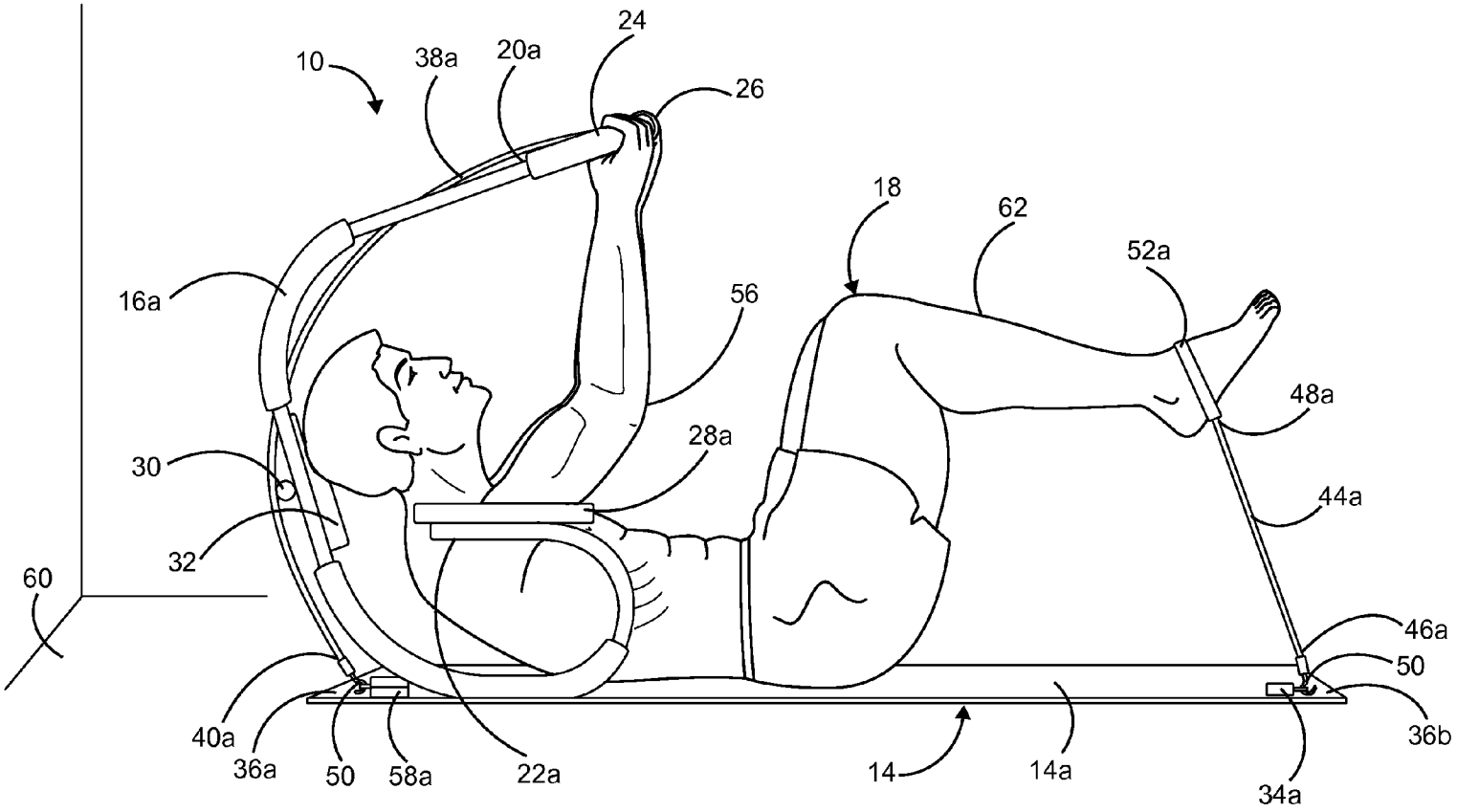
FIG. 6 is a side perspective view of the abdominal exercise machine while in use to perform lower abdominal exercises.

Referring specifically to FIG. 6 of the drawings, the user 18 is performing the abdominal workouts for upper and lower abdominal muscles. The user 18 inserts the right foot holding means 52*a* and the left foot holding means 52*b* into the right and the left feet 54 respectively. As the user 18 lifts the legs 62, the lower right resistance band 44*a* and the lower left resistance band 44*b* get stretched and creates the weighted resistance that enables the user 18 for strong lower abdominal workouts. In this position as described hereinabove and illustrated in FIG. 6, the user 18 performs the upper and the lower abdominal exercises simultaneously. In the preferred embodiment, the head support member 32 and the back support member 14 provide intense support to the head and the back portion of the user 18 during the crunch-type exercises and leg raise exercises for the upper and lower abdominal muscles.

The back support member 14, the upper right resistance band 38*a*, the upper left resistance band 38*b*, the lower right resistance band a 44*a*, the lower left resistance band 44*b*, the first lower weight 34*a*, the second lower weight 34*b* and the plurality of attachment means 26 can be dismantled from the support frame assembly 12 and can be easily assembled prior to use.

While a particular form of the invention has been illustrated and described, it will be apparent that various modifications can be made without departing from the spirit and scope of the invention. For example, components of the abdominal exercise machine 10 can be varied in size, materials, shape, configuration, function, method of exercises and assembly in accordance with the intended use. In addition, the head support member 32 and the right and left arm supporting members 28*a* and 28*b* can be automatically adjusted angularly. Accordingly, it is not intended that the invention be limited, except as by the appended claims.

What is claimed is:

1. An abdominal exercise machine comprising:

a support frame assembly comprising:

a right frame member;

a left frame member;

an upper crossbar adaptable to connect the right frame member and the left frame member with each other, the upper crossbar includes a plurality of attachment means;

a right arm supporting member connected to the right frame member;

a left arm supporting member connected to the left frame member; and a lower crossbar attached with the right frame member and the left frame member;

a back support member having a top surface, a bottom surface, the top surface includes a first upper weight, a second upper weight, a first lower weight and a second lower weight;

an upper right resistance band connected to one of the plurality of attachment means and the first upper weight;

an upper left resistance band connected to another one of the plurality of attachment means and the second upper weight;

a lower right resistance band connected to the first lower weight and a right foot holding means; and a lower left resistance band connected to the second lower weight and a left foot holding means, the right foot holding means and the left foot holding means being designed to insert onto a user's foot;

whereby the upper right and the upper left resistance bands get stretched when the user pulls the upper crossbar in a downward direction thereby creating a weighted resistance that enables the user for abdominal workouts and the lower right and the lower left resistance bands get stretched when the user lifts the right and the left feet being inserted onto the right and the left foot holding means respectively to create the weighted resistance that enables the user for abdominal workouts.

2. The abdominal exercise machine of claim 1 further comprises a head support member positioned at a middle portion of the lower crossbar, the head support member provides comfort to the head and neck of the user while performing the upper and lower abdominal workouts.

3. The abdominal exercise machine of claim 1 wherein the right frame member and the left frame member are substantially U-shaped.

4. The abdominal exercise machine of claim 1 wherein the right arm supporting member and the left arm supporting member provide better comfort to the user's elbows resting thereon while performing the abdominal workouts.

5. The abdominal exercise machine of claim 1 wherein the right frame member includes a first right end and a second right end and the left frame member includes a first left end and a second left end.

6. The abdominal exercise machine of claim 1 wherein the upper right resistance band includes a first upper right end and a second upper right end, the first upper right end is connected to one of the plurality of attachment means and the second upper right end is connected to the first upper weight.

7. The abdominal exercise machine of claim wherein the upper left resistance band includes a first upper left end and a second upper left end, the first upper left end is connected to the another one of the plurality of attachment means and the second upper left end is connected to the second upper weight.

8. The abdominal exercise machine of claim 1 wherein the lower right resistance band includes a first lower right end and a second lower right end, the first lower right end is connected to the first lower weight and the second lower right end is connected to the right foot holding means.

9. The abdominal exercise machine of claim 1 wherein the lower left resistance band includes a first lower left end and a second lower left end, the first lower left end is connected to the second lower weight and the second lower left end is connected to the left foot holding means.

10. The abdominal exercise machine of claim 5 wherein the right arm supporting member is connected to the second right end of the right frame member and the left arm supporting member is connected to the second left end of the left frame member.

11. An abdominal exercise machine comprising:

a support frame assembly comprising:

a substantially U-shaped right frame member having a first right end and a second right end;

a substantially U-shaped left frame member having a first left end and a second left end;

an upper crossbar having a plurality of attachment means, the upper crossbar being designed to connect with the right frame member and the left frame member;

a right arm supporting member connected to the second right end of the right frame member;

a left arm supporting member connected to the second left end of the left frame member, the right arm supporting member and the left arm supporting member provide better comfort for a user's elbows resting thereon while performing upper and lower abdominal workouts; and a lower crossbar attached with the right frame member and the left frame member, the lower crossbar includes a head support member adaptable to provide comfort to the head and neck of the user;

a back support member having a top surface, a bottom surface, the top surface includes a first upper weight, a second upper weight, a first lower weight and a second lower weight;

an upper right resistance band having a first upper right end and a second upper right end, the upper right resistance band being connected to one of the plurality of attachment means and the first upper weight;

an upper left resistance band having a first upper left end and a second upper left end, the upper left resistance band being connected to another one of the plurality of attachment means and the second upper weight;

a lower right resistance band having a first lower right end and a second lower right end, the lower right resistance band being connected to the first lower weight and a right foot holding means; and a lower left resistance band having a first lower left end and a second lower left end, the lower left resistance band being connected to the second lower weight and a left foot holding means, the right and the left foot holding means being designed to insert onto a user's foot;

whereby the upper right and the upper left resistance bands get stretched when the user pulls the upper crossbar in a downward direction thereby creating a weighted resistance that enables the user to achieve abdominal workouts and the lower right and the lower left resistance bands get stretched when the user lifts the right and the left feet being inserted the right and the left foot holding means respectively to create a weighted resistance that enables the user to achieve abdominal workouts.

12. The abdominal exercise machine of claim 11 wherein the upper crossbar is connected to the first right end of the right frame member and the first left end of the left frame member.

13. The abdominal exercise machine of claim 11 wherein the first upper right end and the second upper right end are connected to one on the plurality of attachment means and the first upper weight respectively utilizing at least one of a plurality of fastening means.

14. The abdominal exercise machine of claim 11 wherein the first upper left end and the second upper left end are connected to another one of the plurality of attachment means and the second upper weight respectively utilizing at least one of a plurality of fastening means.

15. The abdominal exercise machine of claim 11 wherein the first lower right end of the lower right resistance band is connected to the first lower weight utilizing at least one of a plurality of fastening means and the second lower right end of the lower right resistance band is connected to the right foot holding means.

16. The abdominal exercise machine of claim 11 wherein the first lower left end of the lower left resistance band is connected to the second lower weight utilizing at least one of a plurality of fastening means and the second lower left end of the lower left resistance band is connected to the left foot holding means.

17. The abdominal exercise machine of claim 11, wherein the machine is foldable.

18. An abdominal exercise machine comprising:

a support frame assembly comprising:

a substantially U-shaped right frame member having a first right end and a second right end;

a substantially U-shaped left frame member having a first left end and a second left end;

an upper crossbar having a plurality of attachment means, the upper crossbar being designed to connect with the first right end of the right frame member and the first left end of the left frame member;

a right arm supporting member connected to the second right end;

a left arm supporting member connected to the second left end, the right arm supporting member and the left arm supporting member allow a user to rest right and left elbows of the user thereon while performing upper and lower abdominal workouts; and a lower crossbar attached with the right frame member and the left frame member, the lower crossbar includes a head support member attached at a middle portion thereof, the head support member provides comfort to the head and neck of the user while performing the lower and the upper abdominal workouts;

a back support member having a top surface, a bottom surface, the top surface includes a first upper weight, a second upper weight, a first lower weight and a second lower weight;

an upper right resistance band having a first upper right end and a second upper right end, the first upper right end and the second upper right end being releasably connected to one of the plurality of attachment means and the first upper weight respectively utilizing at least one of a plurality of fastening means;

an upper left resistance band having a first upper left end and a second upper left end, the first upper left end and the second upper left end being releasably connected to another one of the plurality of attachment means and the second upper weight utilizing the at least one of the plurality of fastening means;

a lower right resistance band having a first lower right end and a second lower right end, the first lower right end being connected to the first lower weight utilizing the at least one of the plurality of fastening means and the second lower right end being connected to a right foot holding means; and a lower left resistance band having a first lower left end and a second lower left end, the first lower left end being connected to the second lower weight utilizing the at least one of the plurality of fastening means and the second lower left end being connected to a left foot holding means, the right foot holding means and the left foot holding means being designed to insert onto a user's foot;

whereby the upper right and the upper left resistance bands get stretched when the user pulls the upper crossbar in a downward direction thereby creating a weighted resistance that enables the user to achieve abdominal workouts and the lower right and the lower left resistance bands get stretched when the user lifts the right and the left feet being inserted onto the right and the left foot holding means respectively to create a weighted resistance that enables the user to achieve abdominal workouts.

19. The abdominal exercise machine of claim 18 wherein the first upper weight, the second upper weight, the first lower weight and the second lower weight prevent the back support member from slipping while the user performs the upper and lower abdominal workouts.

* * * * *